US010431877B2

(12) United States Patent
Varnoosfaderani et al.

(10) Patent No.: US 10,431,877 B2
(45) Date of Patent: Oct. 1, 2019

(54) BASE STATION ANTENNAS HAVING PARASITIC COUPLING UNITS

(71) Applicant: CommScope Technologies LLC, Hickory, NC (US)

(72) Inventors: Mohammad Vatankhah Varnoosfaderani, Sydney (AU); Syed Muzahir Abbas, Macquarie Park (AU); Zhonghao Hu, Westmead (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/906,186

(22) Filed: Feb. 27, 2018

(65) Prior Publication Data

US 2018/0331419 A1 Nov. 15, 2018

Related U.S. Application Data

(60) Provisional application No. 62/505,174, filed on May 12, 2017.

(51) Int. Cl.
*H01Q 21/00* (2006.01)
*H01Q 1/24* (2006.01)
(Continued)

(52) U.S. Cl.
CPC ..... *H01Q 1/246* (2013.01); *H01Q 1/523* (2013.01); *H01Q 5/30* (2015.01); *H01Q 5/364* (2015.01);
(Continued)

(58) Field of Classification Search
CPC ..... H01Q 9/065; H01Q 9/16; H01Q 5/40; H01Q 5/48; H01Q 21/28; H01Q 21/30;
(Continued)

(56) References Cited

U.S. PATENT DOCUMENTS 5,548,813 A 8/1996 Charas et al.
2002/0070902 A1 6/2002 Johnson et al.
(Continued)

FOREIGN PATENT DOCUMENTS

WO WO 2010/018896 2/2010
WO WO 2017/091307 6/2017

OTHER PUBLICATIONS

Notification of Transmittal of the International Search Report and the Written Opinion of the International Searching Authority, or the Declaration, for corresponding International Application No. PCT/US18/20359, dated May 17, 2018, 17 pp.

*Primary Examiner* — Binh B Tran
(74) *Attorney, Agent, or Firm* — Myers Bigel, P.A.

(57) ABSTRACT

A base station antenna includes a panel that has a ground plane, first and second arrays that have respective first and second sets of linearly arranged radiating elements mounted on the panel, and a decoupling unit positioned between a first radiating element of the first array and a first radiating element of the second array. The decoupling unit includes at least a first sidewall that faces the first radiating element of the first array, a second sidewall that faces the first radiating element of the second array and an internal cavity that is defined in the region between the sidewalls. The first and second sidewalls are electrically conductive and electrically connected to the ground plane.

22 Claims, 8 Drawing Sheets

(51) Int. Cl.

| | |
|---|---|
| ***H01Q 5/30*** | (2015.01) |
| ***H01Q 13/10*** | (2006.01) |
| ***H01Q 1/52*** | (2006.01) |
| ***H01Q 9/16*** | (2006.01) |
| ***H01Q 5/364*** | (2015.01) |
| ***H01Q 5/48*** | (2015.01) |
| *H01Q 19/10* | (2006.01) |
| *H01Q 19/185* | (2006.01) |
| *H01Q 9/06* | (2006.01) |
| *H01Q 5/40* | (2015.01) |
| *H01Q 11/18* | (2006.01) |
| *H01Q 1/42* | (2006.01) |
| *H01Q 15/00* | (2006.01) |
| *H01Q 21/26* | (2006.01) |
| *H01Q 21/28* | (2006.01) |
| *H01Q 25/00* | (2006.01) |

(52) U.S. Cl.
CPC ..... *H01Q 5/48* (2015.01); *H01Q 9/16* (2013.01); *H01Q 13/10* (2013.01); *H01Q 21/00* (2013.01); *H01Q 21/0006* (2013.01); *H01Q 1/42* (2013.01); *H01Q 5/40* (2015.01); *H01Q 9/065* (2013.01); *H01Q 11/18* (2013.01); *H01Q 15/0006* (2013.01); *H01Q 19/185* (2013.01); *H01Q 21/26* (2013.01); *H01Q 21/28* (2013.01); *H01Q 25/001* (2013.01)

(58) Field of Classification Search
CPC ..... H01Q 9/28; H01Q 21/08; H01Q 21/20; H01Q 21/24; H01Q 21/26
USPC ..... 343/793–797, 810, 812–819, 834–837
See application file for complete search history.

(56) References Cited

U.S. PATENT DOCUMENTS

| | | | | |
|---|---|---|---|---|
| 2003/0193446 | A1 | 10/2003 | Chen | |
| 2005/0073465 | A1 | 4/2005 | Olson | |
| 2010/0013729 | A1* | 1/2010 | Harel | H01Q 1/246 343/837 |
| 2011/0006949 | A1 | 1/2011 | Webb | |
| 2012/0013519 | A1 | 1/2012 | Håkansson et al. | |
| 2013/0293425 | A1 | 11/2013 | Zhu et al. | |
| 2014/0043195 | A1 | 2/2014 | Ho et al. | |
| 2014/0152523 | A1 | 6/2014 | Wu et al. | |
| 2014/0191042 | A1 | 7/2014 | Brown et al. | |
| 2014/0266922 | A1 | 9/2014 | Jin et al. | |
| 2016/0254594 | A1 | 9/2016 | Jones et al. | |
| 2018/0034164 | A1* | 2/2018 | Jang | H01Q 5/30 |

* cited by examiner

BASE STATION ANTENNAS HAVING PARASITIC COUPLING UNITS

CROSS-REFERENCE TO RELATED APPLICATION

The present applications claims priority under 35 U.S.C. § 119 to U.S. Provisional Patent Application Ser. No. 62/505,174, filed May 12, 2017, the entire content of which is incorporated herein by reference as if set forth in its entirety.

FIELD OF THE INVENTION

The present invention generally relates to radio communications and, more particularly, to base station antennas for cellular communications systems.

BACKGROUND

Cellular communications systems are well known in the art. In a cellular communications system, a geographic area is divided into a series of regions that are referred to as "cells" which are served by respective base stations. Each base station may include one or more base station antennas that are configured to provide two-way radio frequency ("RF") communications with fixed and mobile subscribers that are located within the cell served by the base station. Typically, a base station antenna includes at least one vertically-oriented linear array of radiating elements.

In many cases, each base station is divided into "sectors." In a common configuration, a hexagonally shaped cell is divided into three 120° sectors, and each sector is served by one or more base station antennas. The linear array of radiating elements on each base station antenna may have a radiation pattern (also referred to herein as an "antenna beam") that is directed outwardly in the general direction of the horizon, where the radiation pattern has an azimuth Half Power Beamwidth (HPBW) of approximately 65° so that the radiation pattern will provide coverage to the full 120° sector.

As demand for additional capacity has increased, the use of multi-band base station antennas has become widespread. A multi-band base station antenna includes multiple vertically-oriented linear arrays of radiating elements that are mounted on a common backplane. Typically somewhere between two and four linear arrays of radiating elements are provided, with one or more of the linear arrays providing service in a first frequency band and the remaining linear arrays providing service in one or more additional, different frequency bands. One common multi-band base station antenna design is the RVV antenna, which includes one linear array of "low-band" radiating elements that are used to provide service in some or all of, for example, the 694-960 MHz frequency band (which is often referred to as the "R-band") and two linear arrays of "high-band" radiating elements that are used to provide service in some or all of, for example, the 1695-2690 MHz frequency band (which is often referred to as the "V-band"). The three linear arrays of radiating elements are mounted in side-by-side fashion. Another known multi-band base station antenna is the RRVV base station antenna, which has two linear arrays of low-band radiating elements and two (or four) linear arrays of high-band radiating elements. RRVV antennas are used in a variety of applications including 4×4 multi-input-multi-output ("MIMO") applications or as multi-band antennas having two different low-bands (e.g., a 700 MHz low-band linear array and an 800 MHz low-band linear array) and two different high bands (e.g., an 1800 MHz high-band linear array and a 2100 MHz high-band linear array).

RRVV antennas and other antennas that include four or more linear arrays and/or two or more linear arrays of low-band radiating elements may be challenging to implement in a commercially acceptable manner because operators typically desire base station antennas that are relatively narrow in width, such as base station antennas with maximum widths in the 300-380 mm range. Mounting two low-band linear arrays and/or four or more total linear arrays side-by-side within this relatively narrow space while maintaining acceptable performance may be difficult.

SUMMARY

Pursuant to embodiments of the present invention, base station antennas are provided that include a panel that includes a ground plane, a first linear array that includes a first plurality of radiating elements that extend forwardly from the panel, the first linear array extending along a first axis, a second linear array that includes a second plurality of radiating elements that extend forwardly from the panel, the second linear array extending along a second axis that is generally parallel to the first axis, and a parasitic coupling unit between a first radiating element of the first linear array and a first radiating element of the second linear array and between the first axis and the second axis. The parasitic coupling unit includes a first parasitic coupling structure, the first parasitic coupling structure including a first base that is capacitively coupled to the ground plane and a first wall that extends forwardly from the first base, the first wall including at least one slot.

In some embodiments, the first wall extends along a third axis that is generally parallel to the second axis, and the at least one slot extends along a fourth axis that is generally parallel to the second axis.

In some embodiments, the parasitic coupling unit further includes a second parasitic coupling structure, the second parasitic coupling structure including a second base that is capacitively coupled to the ground plane and a second wall that extends upwardly from the second base and extends parallel to the first wall, the second wall including at least one slot. Each of the first and second walls may include at least two slots that extend in parallel to each other. The first parasitic coupling structure may be spaced apart from the second parasitic coupling structure and may not directly contact the second parasitic coupling structure.

In some embodiments, the parasitic coupling unit further includes a dielectric spacer that separates the parasitic coupling unit from the ground plane. The first base may include a plurality of mounting apertures, and a plurality of dielectric fasteners may extend through the respective mounting apertures to attach the first parasitic coupling structure with the ground plane with the dielectric spacer therebetween.

In some embodiments, the first base extends parallel to the ground plane. In some embodiments, a height of the first wall above the ground plane is less than a height of at least one of the first plurality of radiating elements above the ground plane.

In some embodiments, the base station antenna may further include a third plurality of radiating elements that are part of a third linear array and a fourth plurality of radiating elements that are part of a fourth linear array. The first parasitic coupling structure may be between a first of the first plurality of radiating elements and a first of the second plurality of radiating elements, and may further be between a first of the third plurality of radiating elements and a first of the fourth plurality of radiating elements, and each radiating element in the first plurality of radiating elements may be configured to transmit and receive radio frequency signals in at least a first portion of a first frequency band, each radiating element in the second plurality of radiating elements may be configured to transmit and receive radio frequency signals in at least a second portion of the first frequency band, each radiating element in the third plurality of radiating elements may be configured to transmit and receive radio frequency signals in at least a first portion of a second frequency band that is higher than the first frequency band, and each radiating element in the fourth plurality of radiating elements may be configured to transmit and receive radio frequency signals in at least a second portion of the second frequency band.

In such embodiments, a height of the first wall above the ground plane may be at least two thirds a height of at least one of the third plurality of radiating elements above the ground plane. Additionally, the first parasitic coupling structure may be configured to act as a radiation shield that isolates at least one of the third radiating elements from at least one of the fourth radiating elements.

In some embodiments, the first parasitic coupling structure has an L-shaped cross-section.

In some embodiments, the first and second parasitic coupling structures define an internal cavity therebetween, and a mounting structure for a parasitic strip extends upwardly from the ground plane through the internal cavity.

In some embodiments, a length of the first wall is at least as long as a length of the at least one slot and no more than the length of the ground plane.

In some embodiments, a height of the at least one slot in a direction perpendicular to a plane defined by the ground plane is between 0.02λ, and 0.15λ, where λ is a wavelength corresponding to a center frequency of the combined operating frequency band of the first and second linear arrays. In such embodiments, a length of each slot in a direction parallel to the plane defined by the ground plane may be between 0.4λ and 0.6λ.

In some embodiments, the parasitic coupling unit is configured to collect RF energy radiated by the first linear array and to re-radiate at least some of the collected RF energy.

Pursuant to further embodiments of the present invention, base station antennas are provided that include a panel that includes a ground plane, a first linear array that includes a first plurality radiating elements that extend forwardly from the panel, the first linear array extending along a first axis, a second linear array that includes a second plurality of radiating elements that extend forwardly from the panel, the second linear array extending along a second axis that is generally parallel to the first axis, and a plurality of parasitic coupling units extending along a third axis between the first linear array and the second linear array. In these antennas, each parasitic coupling unit comprises spaced-apart first and second metal parasitic coupling structures that face each other to define an internal cavity therebetween, each parasitic coupling structure including a base and a wall that extends forwardly from the base. Additionally, at least some of the parasitic coupling units are tuned to increase the phase alignment between RF energy radiated by the first linear array that is not absorbed by elements of the base station antenna and RF energy radiated by the first linear array that is absorbed by ones of the second plurality of radiating elements and re-radiated therefrom.

Each wall may include one, two or more slots that extend generally parallel to the second axis. Each of the first and second metal parasitic coupling structures may be mounted on a respective dielectric spacer and is capacitively coupled to the ground plane. The first metal parasitic coupling structure may not directly contact the second metal parasitic coupling structure. A height of each wall above the ground plane may be less than one half a height of at least one of the first plurality of radiating elements above the ground plane In some embodiments, the first parasitic coupling structure may be positioned between a first of the first plurality of radiating elements and a first of the second plurality of radiating elements, and may be further positioned between a first of a third plurality of radiating elements that are part of a third linear array and a first of a fourth plurality of radiating elements that are part of a fourth linear array. In such embodiments, each radiating element in the first plurality of radiating elements may be configured to transmit and receive radio frequency signals in at least a first portion of a first frequency band, each radiating element in the second plurality of radiating elements may be configured to transmit and receive radio frequency signals in at least a second portion of the first frequency band, each radiating element in the third plurality of radiating elements may be configured to transmit and receive radio frequency signals in at least a first portion of a second frequency band that is at higher frequencies than the first frequency band, and each radiating element in the fourth plurality of radiating elements may be configured to transmit and receive radio frequency signals in at least a second portion of the second frequency band.

A height of the each wall above the ground plane may be at least two thirds a height of at least one of the third plurality of radiating elements above the ground plane. The first parasitic coupling structure may be configured to act as an RF shield that isolates at least one of the third radiating elements from at least one of the fourth radiating elements. A length of each slot in a direction parallel to the plane defined by the ground plane may be between 0.4λ, and 0.6λ, where λ is a wavelength corresponding to a center frequency of the combined operating frequency band of the first and second linear arrays.

Pursuant to still further embodiments of the present invention, base station antennas are provided that include a panel that includes a ground plane, a first low-band linear array that includes a first plurality of low-band radiating elements that are mounted to extend forwardly from the panel, a second low-band linear array that includes a second plurality of low-band radiating elements that are mounted to extend forwardly from the panel, a first high-band linear array that includes a first plurality of high-band radiating elements that are mounted to extend forwardly from the panel, a second high-band linear array that includes a second plurality of high-band radiating elements that are mounted to extend forwardly from the panel, and a plurality of parasitic coupling units extending along an axis between the first low-band linear array and the second low-band linear array. Each low-band radiating element is configured to transmit and receive radio frequency signals in at least a portion of a first frequency band and each high-band radiating element is configured to transmit and receive radio frequency signals in at least a portion of a second frequency band that has a lowest frequency that is higher in frequency than the highest frequency in the first frequency band. Each parasitic coupling unit comprises a base and a wall that extends forwardly from the base and is configured to collect and re-radiate RF energy in the first frequency band.

The plurality of parasitic coupling units may also extend between the first high-band linear array and the second high-band linear array, and/or may be configured to act as RF shields that isolate the first high-band linear array from the second high-band linear array.

DETAILED DESCRIPTION

Figure 1:
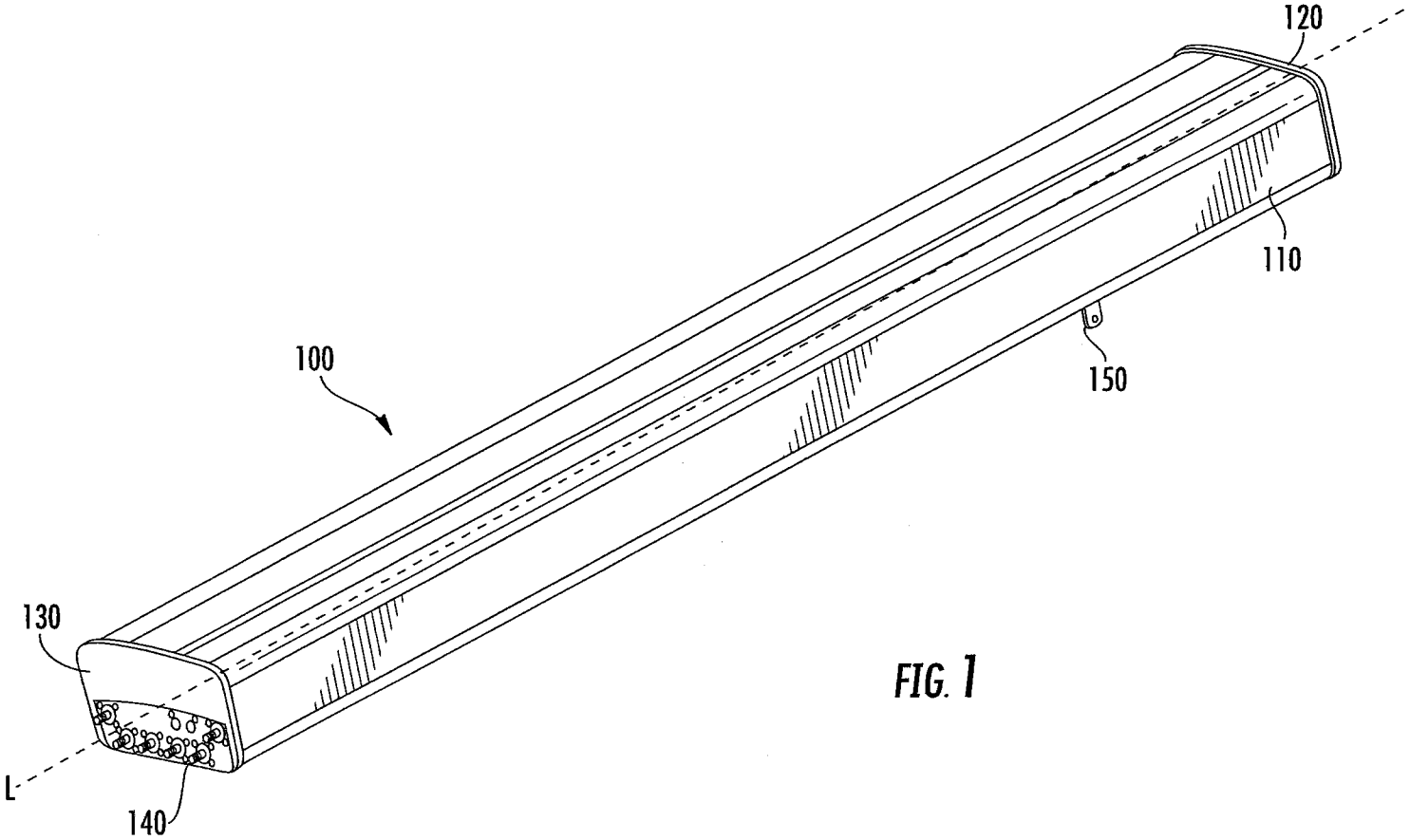
FIG. 1 is a perspective view of a base station antenna according to embodiments of the present invention.

As discussed above, multi-band base station antennas often include multiple linear arrays of radiating elements that are mounted in side-by-side fashion on a relatively narrow backplane. Unfortunately, when multiple linear arrays of radiating elements are mounted in close proximity to each other, cross coupling may occur between the radiating elements of different linear arrays. For example, an RRVV antenna may include first and second linear arrays of low-band radiating elements that extend down the respective sides of the antenna, and first and second linear arrays of high-band radiating elements that are mounted between the first and second linear arrays of low-band radiating elements, with each linear array in very close proximity to the linear array(s) adjacent thereto. When signals are transmitted through a first of these linear arrays, a portion of the transmitted RF energy may cross-couple to the radiating elements of one or more of the other linear arrays. This cross-coupling can distort the radiation patterns of the transmitting linear array in terms of, for example, azimuth beam width, beam squint and/or cross polarization. The amount of distortion will typically increase with increased cross-coupling, and hence the distortion in the antenna patterns will tend to occur at the frequencies where the cross-coupling is strongest. As noted above, the radiation patterns are designed to cover a certain portion of the azimuth plane, and hence the perturbations to the radiation pattern caused by the cross-coupling may tend to reduce the performance of the base station antenna. Consequently, it may be desirable to reduce cross-coupling between radiating elements of different linear arrays in order to improve the radiation pattern performance of the base station antenna and/or to control the cross-coupling that does occur so that it does not significantly degrade the radiation pattern of the transmitting linear array.

Pursuant to embodiments of the present invention, parasitic coupling units are provided that may be used to improve the shape of the radiation patterns of first and second linear arrays of a base station antenna. The parasitic coupling units may extend forwardly from the backplane of the antenna and may be positioned between the first and second linear arrays. In some embodiments, each parasitic coupling unit may comprise a pair of facing parasitic coupling structures that each have an L-shaped cross-section. In other embodiments, the parasitic coupling unit may comprises a single parasitic coupling structure. In each case, a plurality of these parasitic coupling units may extend between the first and second linear arrays.

In some embodiments, each parasitic coupling structure may include a base and a wall extending upwardly from the base (i.e., the wall extends generally forwardly from the backplane when the base station antenna is mounted for use). One or more slots may be provided in the wall. Each slot may comprise an elongated opening in the wall that extends all the way through the wall. If multiple slots are provided, the slots may extend in parallel to one another, and each slot may extend along a generally vertical axis when the base station antenna is mounted for use. The length of the slots and/or the number of slots may be varied to tune the radiation patterns of the first and second linear arrays. In some embodiments, each parasitic coupling unit may extend only a relatively short distance forwardly from the backplane of the antenna. For example, each parasitic coupling unit may extend forwardly less than half the distance that the radiating elements of the first and second linear arrays extend forwardly from the backplane.

The parasitic coupling units may be positioned between radiating elements of the first and second linear arrays of a base station antenna in order to control the cross-coupling between the radiating elements of the first and second linear arrays. The parasitic coupling units may be mounted to the backplane of the base station antenna, and a dielectric spacer may be positioned between each parasitic coupling unit and the backplane. The backplane may serve as a ground plane for the radiating elements. The dielectric spacer may be transparent to RF signals, which capacitively couple between the ground plane and the parasitic coupling unit, while blocking direct current (DC) and low frequency signals from passing between the ground plane and the parasitic coupling unit.

When a first linear array of radiating elements that is near the parasitic coupling unit transmits an RF signal, the electromagnetic field that is generated by the first linear array may extend onto the parasitic coupling unit. The magnetic field perpendicular to one or more slots included in the parasitic coupling unit induce surface currents around or along the slot(s). These surface currents may cause RF energy to re-radiate, some of which may couple to radiating elements of the second linear array from where it may once again re-radiate. The slots in the parasitic coupling unit may act as resonant parasitic magnetic dipoles, with the longest dimension of each slot being the dominant radiator. If the re-radiated signal from the parasitic coupling unit is in phase with the radiating element, then the half power beamwidth will be decreased in the azimuth plane. While the parasitic coupling units may actually increase the amount of coupling between the two linear arrays, the coupling may be tuned so that it improves the radiation pattern of each linear array, or at least reduces the negative impacts thereof.

In some embodiments, the parasitic coupling units may be incorporated into a base station antenna having at least two linear arrays of low-band radiating elements and at least two linear arrays of high-band radiating elements. The parasitic coupling units may be positioned so that they are between both high-band linear arrays and so that they also are between both low-band linear arrays. In such an implementation, the parasitic coupling units may act as parasitic coupling units for the low-band linear arrays and may act as RF isolation structures (shields) for the high-band linear arrays.

Aspects of the present invention will now be discussed in greater detail with reference to the drawings, in which example embodiments are shown.

Figure 2:
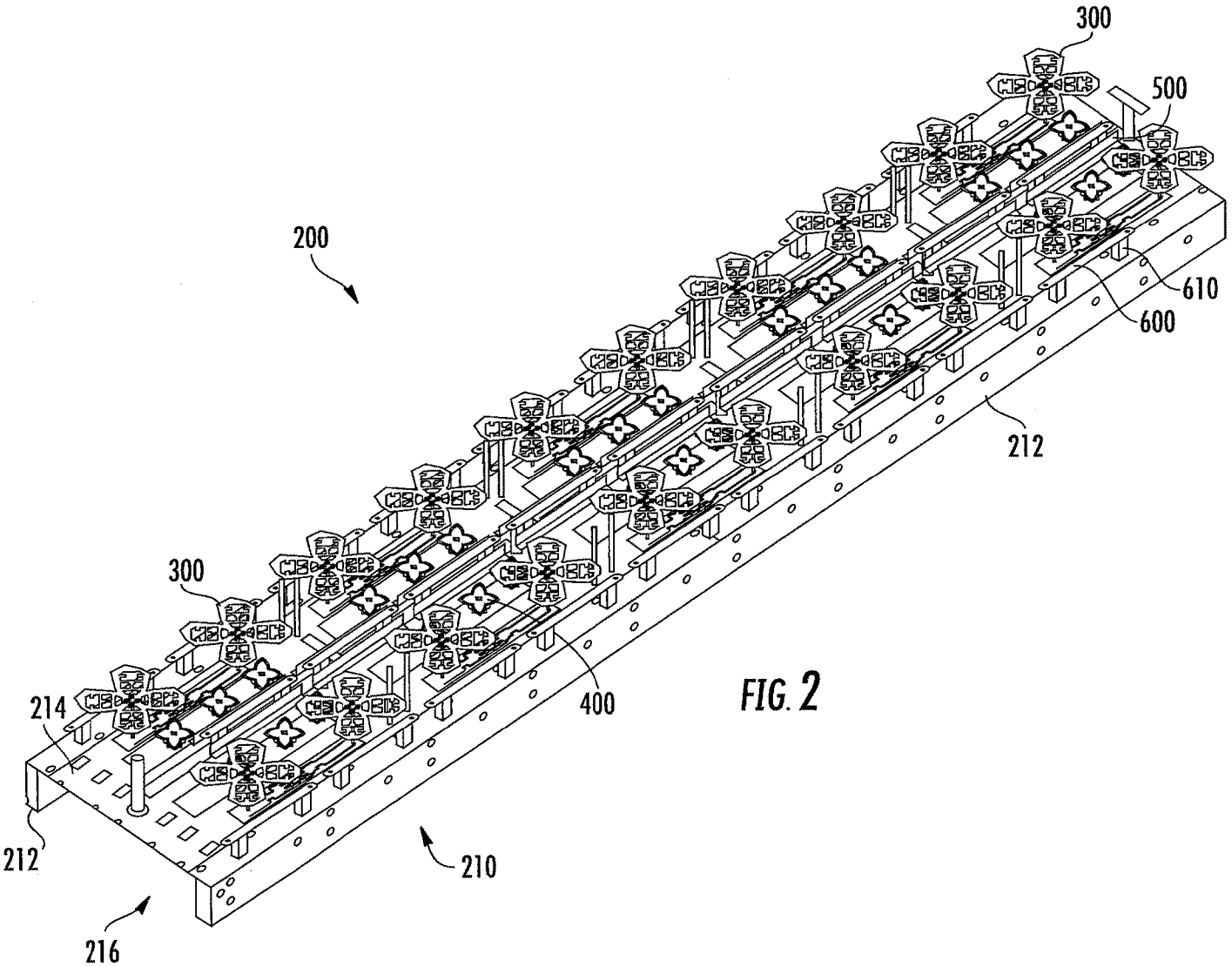
FIG. 2 is a perspective view of an antenna assembly of the base station antenna of FIG. 1.
Figure 3:
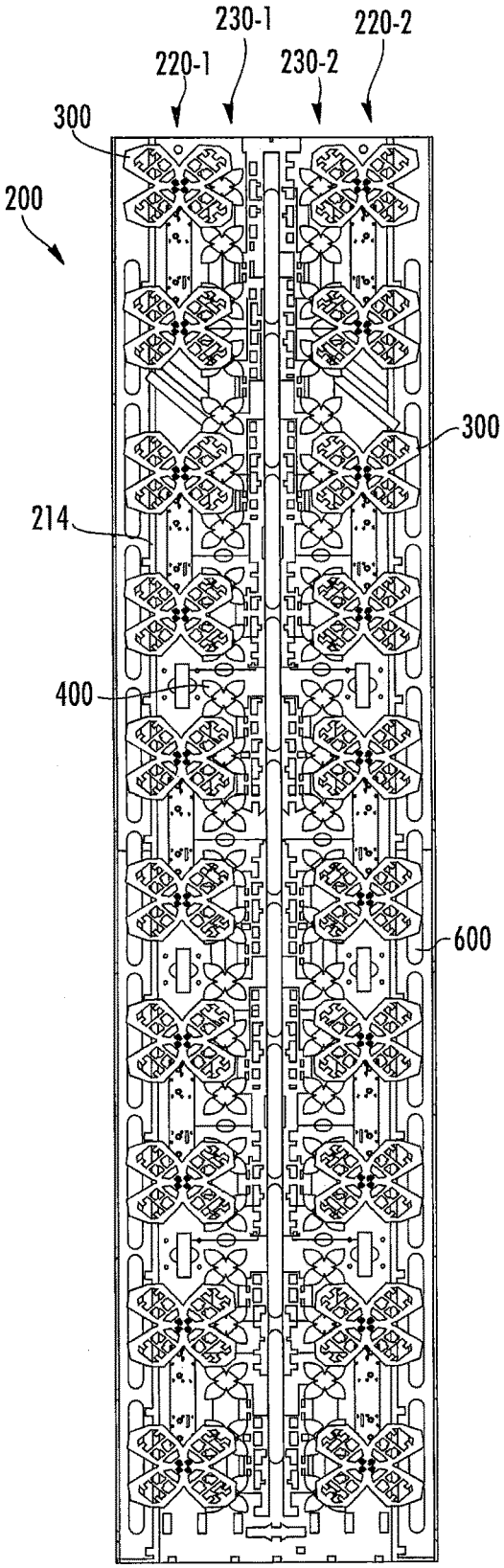
FIG. 3 is a front view of the antenna assembly of FIG. 2.
Figure 4:
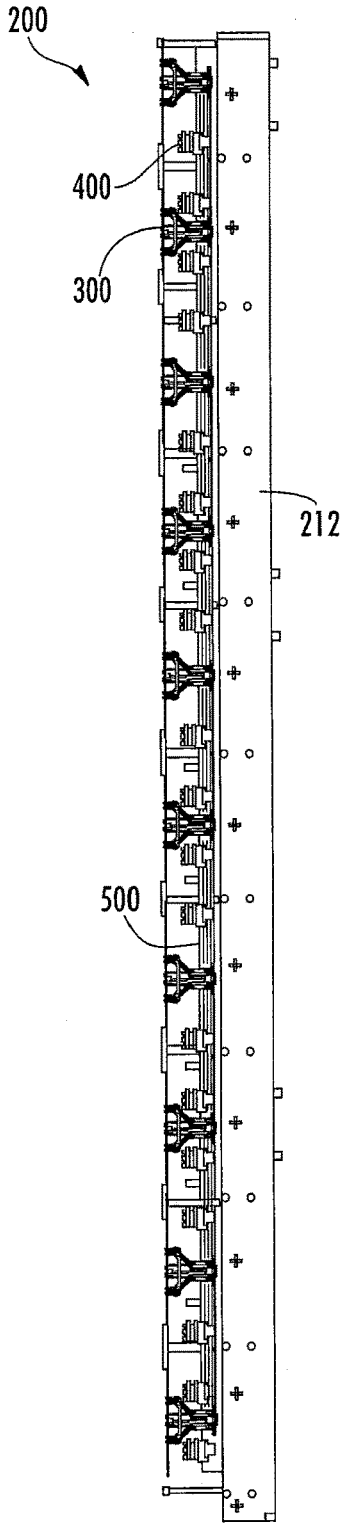
FIG. 4 is a side view of the antenna assembly of FIG. 2.
Figure 5:
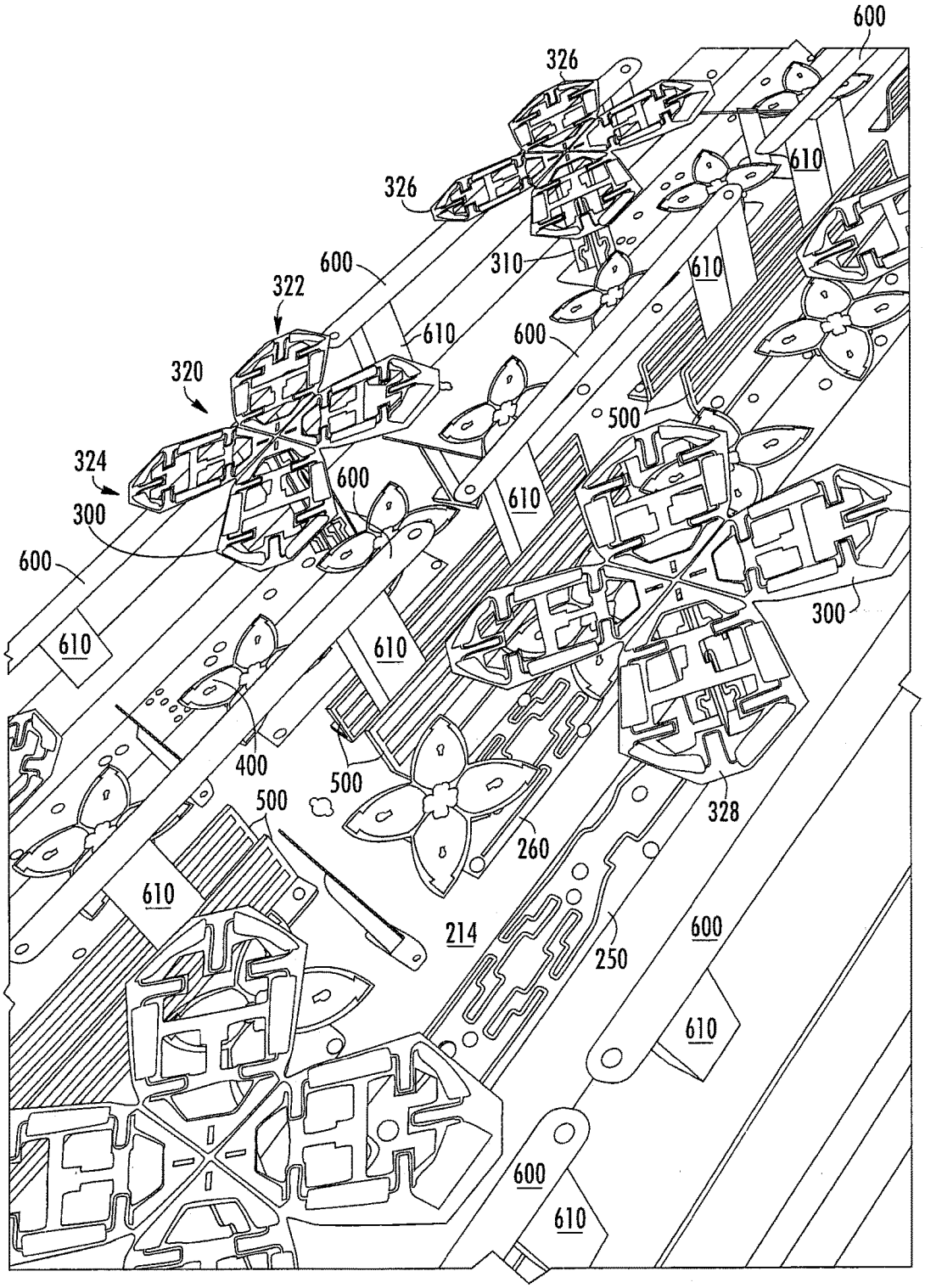
FIGS. 5 and 6 are enlarged perspective views of various portions of the of the antenna assembly of FIGS. 2-4.
Figure 6:
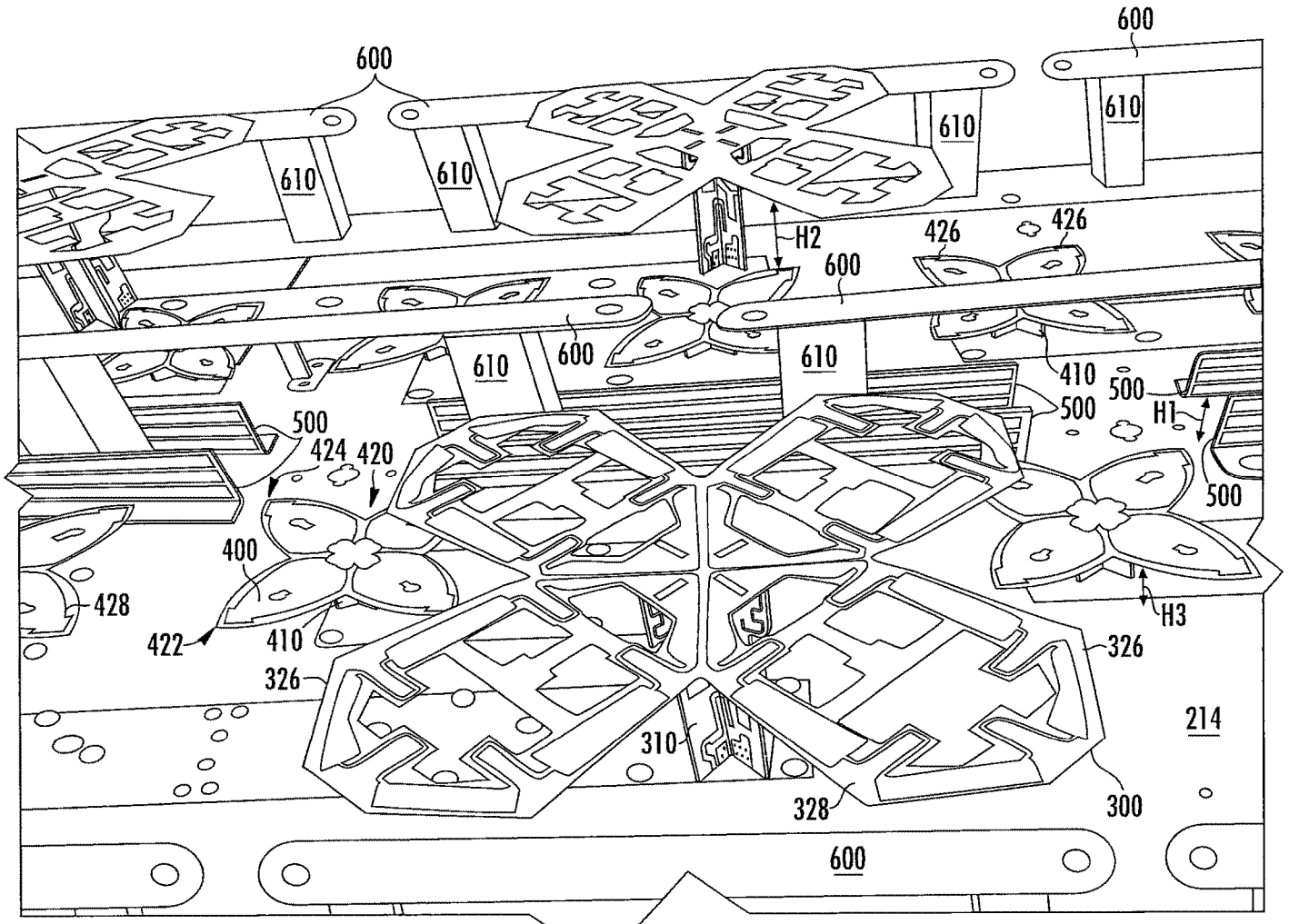

FIGS. 1-6 illustrate a base station antenna 100 according to certain embodiments of the present invention. In particular, FIG. 1 is a front perspective view of the base station antenna 100, while FIGS. 2-4 are a perspective view, a front view and side view, respectively, of an antenna assembly 200 that is included within the radome of base station antenna 100. FIGS. 5 and 6 are enlarged partial perspective views of the antenna assembly 200.

As shown in FIGS. 1-6, the base station antenna 100 is an elongated structure that extends along a longitudinal axis L. When mounted for use, the axis L will generally be oriented vertically (i.e., perpendicular to the plane defined by the horizon). The description of the base station antenna 100 and the antenna assembly 200 thereof that follows will describe the constituent elements thereof assuming that the base station antenna 100 is mounted for use on a tower with the longitudinal axis L of the antenna 100 extending along a vertical axis (i.e., an axis that is generally perpendicular to a plane defined by the horizon) and the front surface of the antenna 100 mounted opposite the tower pointing toward the coverage area for the antenna 100. Thus, for example, the linear arrays of the base station antenna 100 may be referred to as being "vertically-oriented" linear arrays, as each linear array will generally extend along a respective vertical axis when the base station antenna 100 is mounted for use. The one exception to this convention is references to the "heights" of the radiating elements and the parasitic coupling units of base station antenna 100 above the ground plane. While "height" typically refers to a distance in the vertical dimension, here the referenced heights describe how far forwardly the radiating elements and parasitic coupling units extend from the ground plane when the antenna 100 is mounted for use.

Referring to FIG. 1, the base station antenna 100 may have a tubular shape with generally rectangular cross-section. The antenna 100 includes a radome 110 and a top end cap 120. One or more mounting brackets 150 are provided on the rear side of the radome 110 which may be used to mount the base station antenna 100 onto an antenna mount (not shown) on, for example, an antenna tower. The base station antenna 100 also includes a bottom end cap 130 which includes a plurality of connectors 140 mounted therein.

As shown in FIGS. 2-4, the base station antenna 100 includes an antenna assembly 200 that may be slidably inserted into the radome 110 from either the top or bottom before the top cap 120 or bottom cap 130 are attached to the radome 110. The antenna assembly 200 includes a backplane 210 that has sidewalls 212 and a front surface that acts as a reflector 214. The reflector 214 may comprise a metallic surface (which may or may not comprise a single sheet of metal) that also serves as a ground plane for the radiating elements of the base station antenna 100. A chamber 216 may be defined between the sidewalls 212 and the back side of the reflector surface 214. Various mechanical and electronic components of the base station antenna 100 may be mounted in the chamber 216 such as, for example, phase shifters, remote electronic tilt ("RET") units, mechanical linkages, a controller, diplexers, and the like.

A plurality of radiating elements 300, 400 are mounted to extend forwardly from the reflector 214. The radiating elements may include low-band radiating elements 300 and high-band radiating elements 400. As shown best in FIG. 3, the low-band radiating elements 300 are mounted in two vertical columns to form two vertically-oriented linear arrays 220-1, 220-2 of low-band radiating elements 300. Each linear array 220 may extend along substantially the full length of the base station antenna 100 in some embodiments. The high-band radiating elements 400 may likewise be mounted in two vertical columns to form two vertically-oriented linear arrays 230-1, 230-2 of high-band radiating elements 400. The four linear arrays 220, 230 may be mounted side-by-side on the backplane 210. Herein, when the base station antennas according to embodiments of the present invention include multiple of the same components, these components may be referred to individually by their full reference numerals (e.g., low-band linear array 220-1) and may be referred to collectively by the first part of their reference numeral (e.g., the low-band linear arrays 220).

The linear arrays 230 of high-band radiating elements 400 are positioned between the linear arrays 220 low-band radiating elements 300. The low-band linear arrays 220-1, 220-2 may be configured to transmit and receive signals in all or part of a first frequency band. In some embodiments, the first frequency band may comprise the 694-960 MHz frequency band or a portion thereof. The low-band linear arrays 220-1, 220-2 may or may not be configured to transmit and receive signals in the same portion of the first frequency band. The high-band linear arrays 230-1, 230-2 may be configured to transmit and receive signals in a second frequency band that is at higher frequencies than the first frequency band. In some embodiments, the second frequency band may comprise the 1695-2690 MHz frequency band or a portion thereof. The high-band linear arrays 230-1, 230-2 may or may not be configured to transmit and receive signals in the same portion of the second frequency band.

As is also shown in FIG. 2, a plurality of parasitic coupling units 500 may extend forwardly from the reflector 214. The parasitic coupling units 500 may be mounted along the centreline of the antenna 100 to form a vertically-oriented column of parasitic coupling units 500. The column of parasitic coupling units 500 may extend between the two high-band linear arrays 230-1, 230-2. The parasitic coupling units 500 will be discussed in greater detail below with reference to FIG. 7.

FIGS. 5-6 are enlarged perspective views of portions of the antenna assembly 200 that illustrate several of the radiating elements 300, 400 and the parasitic coupling units 500 in greater detail. As can be seen in FIGS. 2-3 and 5-6, each low-band radiating element 300 in the first low-band linear array 220-1 is located in relatively close proximity to a low-band radiating element 300 in the second low-band linear array 220-2. In fact, as can be seen in FIG. 3, the spacing between the two low-band linear arrays 220-1, 220-2 may be less than the width of a low-band radiating element 300. The two high-band linear arrays 230-1, 230-2 are in even closer physical proximity to each other, although in terms of operating wavelength, the high-band linear arrays 230-1, 230-2 may be spaced further apart than the low-band linear arrays 220-1, 220-2, since the operating wavelength of the low-band linear arrays 220-1, 220-2 may be approximately two to three times the operating wavelength of the high-band linear arrays 230-1, 230-2.

Still referring to FIGS. 5 and 6, each low-band radiating element 300 may include a feed stalk 310 and one or more radiators 320. The feed stalks 310 may comprise, for example, printed circuit boards having RF transmission lines thereon that carry RF signals to and from the radiators 320. The feed stalks 310 mount the radiators 320 above the reflector/ground plane 214. The radiators 320 comprise a pair of cross-dipole radiators 322, 324 that are designed to transmit and receive RF signals at slant +45° and −45° linear polarizations. Each radiator 322, 324 may comprise a pair of λ/4 dipole arms 326. All four dipole arms 326 of radiators 322 and 324 may be provided on a common printed circuit board 328. Likewise, each high-band radiating element 400 may include a feed stalk 410 and one or more radiators 420. The feed stalks 410 may comprise, for example, printed circuit boards having RF transmission lines thereon that carry RF signals to and from the radiators 420. The feed stalks 410 mount the radiators 420 above the reflector/ground plane 214. The radiators 420 comprise a pair of cross-dipole radiators 422, 424 that are designed to transmit and receive RF signals at slant +45° and −45° linear polarizations. Each radiator 422, 424 may comprise a pair of λ/4 dipole arms 426. All four dipole arms 426 of radiators 422 and 424 may be provided on a common printed circuit board 428.

Each low-band linear array 220-1, 220-2 and each high-band linear array 230-1, 230-2 may form a separate antenna beam at each of two different polarizations (since the radiating elements 300, 400 are dual polarized radiating elements). Each low-band radiating element 300 in the first low-band linear array 220-1 may be horizontally aligned (i.e., aligned along a plane that is parallel to the plane defined by the horizon when the antenna 100 is mounted for normal use) with a respective low-band radiating element 300 in the second low-band linear array 220-2. Likewise, each high-band radiating element 400 in the first high-band linear array 230-1 may be horizontally aligned with a respective high-band radiating element 400 in the second high-band linear array 230-2. Each low-band linear array 220 may include a plurality of low-band radiating element feed assemblies 250, each of which includes two low-band radiating elements 300. Each high-band linear array 230 may include a plurality of high-band radiating element feed assemblies 260, each of which includes three high-band radiating elements 400. The number of radiating elements 300, 400 per feed assembly 250, 260 may be varied in other embodiments, as may the number of linear arrays 220, 230, the number of radiating elements 300, 400 per linear array 220, 230, etc.

When a signal is transmitted though the low-band radiating elements 300 of the first low-band linear array 220-1, an electromagnetic field is generated. The electromagnetic field may extend to the low-band radiating elements 300 that are part of the second low-band linear array 220-2, and hence signal energy will cross-couple between the low-band radiating elements 300 of the two low-band linear arrays 220. The degree of cross-coupling may be a function of a variety of different factors including, for example, the distance between the low-band radiating elements 300 of the two low-band linear arrays 220, the amplitude of the RF signal transmitted by the low-band radiating elements 300, and the operating frequency of the low-band radiating elements 300. Generally speaking, stronger cross-coupling will occur the smaller the distance between the low-band radiating elements 300, the greater the power of the RF signal transmitted through the low-band radiating elements 300, and the lower the operating frequency since at lower operating frequencies the distance between the two arrays is smaller in terms of wavelength. If the low-band radiating elements 300 of the two low-band linear arrays 220 are designed to transmit in the same frequency band, the cross-coupling tends to be stronger because both radiating elements 300 are impedance matched to operate within the exact same frequency band. Moreover, even in cases where the two low-band linear arrays 220 are designed to transmit in different frequency bands (e.g., one in the 700 MHz frequency band and the other in the 800 MHz frequency band), the cross-coupling still tends to be strong because the low-band radiating elements 300 of the different low-band linear arrays 220 are impedance matched to operate within frequency bands that are not very far apart.

As discussed above, when cross-coupling occurs between radiating elements of two different linear arrays, the azimuth radiation pattern of the transmitting linear array may be distorted. This distortion may, for example, change the azimuth beam width, beam squint and cross polarization isolation (both within a single linear array and/or within two different linear arrays that operate in the same frequency band) at the frequencies where the cross coupling is relatively strong, moving these characteristics away from desired values. The symmetry of the antenna pattern and the gain may also be degraded.

As noted above, pursuant to embodiments of the present invention, base station antennas may be provided that include parasitic coupling units that may be used to tune the cross-coupling between the radiating elements of two different linear arrays that operate in the same or closely-spaced frequency bands. In some embodiments, these parasitic coupling units may also be used as decoupling structures to reduce cross-coupling between the radiating elements of other linear arrays.

Figure 7:
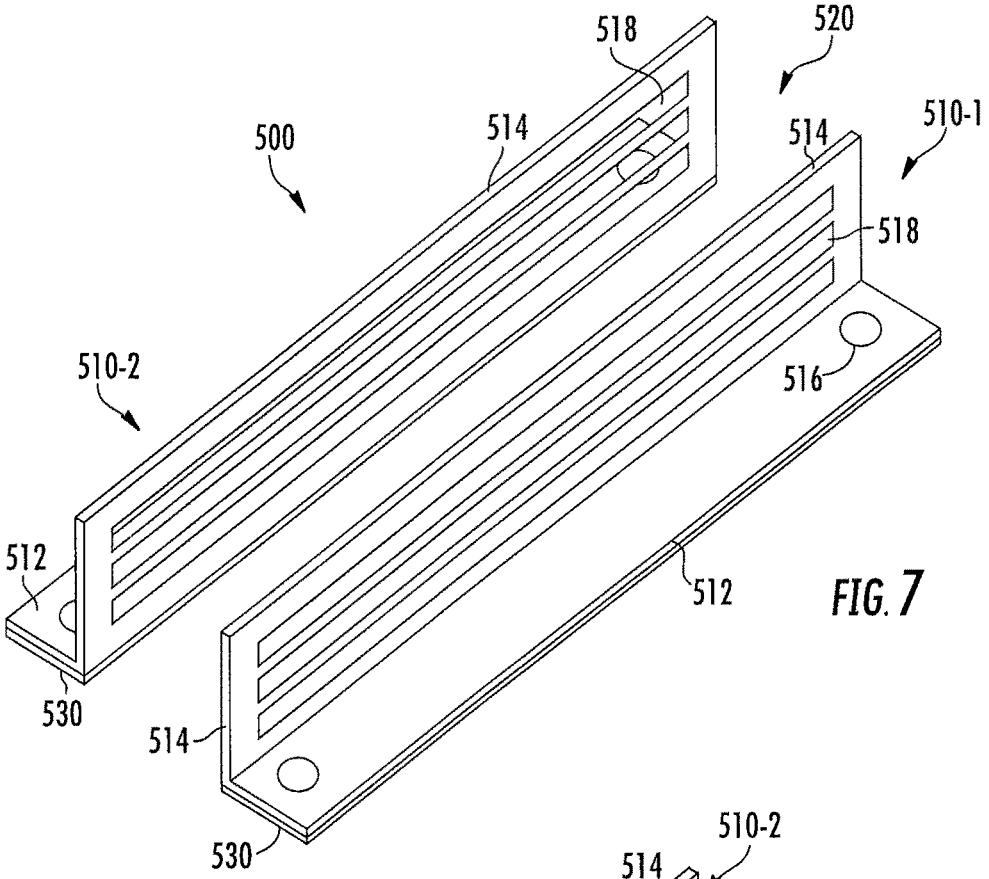
FIG. 7 is a perspective view of a parasitic coupling unit according to embodiments of the present invention.

FIG. 7 is a perspective view of a parasitic coupling unit 500 according to embodiments of the present invention. As discussed above, a plurality of the parasitic coupling unit 500 may be included on the base station antenna 100. In some embodiments, the parasitic coupling units 500 may be collinear with each other, extending along a vertical axis down the center of the backplane 210.

As shown in FIG. 7, the parasitic coupling unit 500 may comprise a pair of elongated parasitic coupling structures 510-1, 510-2 that may each have an L-shaped transverse cross-section. Each parasitic coupling structure 510 may include a base 512 and a wall 514. The parasitic coupling unit 500 does not include any roof. The base 512 may comprise a planar strip that extends along the longitudinal axis L of the base station antenna 100 parallel to a plane defined by the reflector 214. Each wall 514 may extend forwardly from an edge of its associated base 512. In the depicted embodiment, the wall 514 may extend from its associated base 512 at an angle of about ninety degrees, although other angles may be used. Each base 512 may include apertures 516 that may be used to mount the parasitic coupling unit 500 to, for example, the reflector 214 via screws, rivets or other fasteners. The fasteners may be formed of insulating materials so that the fasteners do not provide a direct galvanic connection between the parasitic coupling unit 500 and the ground plane/reflector 214.

Each wall 514 may also comprise a planar strip that extends along the longitudinal axis L of the base station antenna 100 perpendicular to the plane defined by the ground plane/reflector 214. Each wall 514 may include one or more longitudinally extending apertures 518 or "slots." In the depicted embodiment, each wall 514 includes a total of three slots 518. As will be discussed in further detail below, the number, shape, height and/or length of the slots 518 may be varied to tune the parasitic coupling unit 500 in order to improve the radiation patterns of the low-band linear arrays 220 of base station antenna 100. The slots 518 can have various different shapes such as a meander line, bow-tie shape, etc. so long as the electrical length of each slot 518 is within an appropriate range so that the unit 500 will operate as a parasitic coupling unit. In some embodiments, the slots may have an electrical length of between about 0.4 to 0.6 wavelengths.

The parasitic coupling structures 510-1, 510-2 are mounted adjacent each other so that an internal cavity 520 is defined therebetween. The internal cavity 520 is open on each end thereof and also has an open top. The walls 514 and the ground plane/reflector 214 may define the internal cavity 520. In some embodiments, each parasitic coupling structure 510 may be formed of a lightweight metal having good corrosion resistance and electrical conductivity such as, for example, aluminum. In the depicted embodiment, each parasitic coupling structure 510 may be formed by stamping material from a sheet of aluminum and then forming the aluminum into the shape shown in FIG. 7.

As is further shown in FIG. 7, a dielectric spacer 530 may be interposed between each parasitic coupling structure 510 and the underlying ground plane/reflector 214 (which is not depicted in FIG. 7, but extends underneath the dielectric spacer 530). In some embodiments, a single dielectric spacer 530 may be used that is between both parasitic coupling structure 510-1, 510-2 and the ground plane/reflector 214, while in other embodiments a separate, smaller dielectric spacer 530 may be provided for each parasitic coupling structure 510 as is shown in FIG. 7. The dielectric spacer 530 may comprise a planar structure and, in some embodiments, may have the same size and shape as the base 512. The dielectric spacer 530 may be formed of plastic or another suitable dielectric material. Each dielectric spacer 530 may, in combination with the base 512 of one of the parasitic coupling structure 510 and the ground plane/reflector 214, form a capacitive connection between each parasitic coupling structure 510 and the ground plane/reflector 214. This capacitive connection may block DC signals while passing RF signals. A high dielectric constant dielectric spacer 530 may be used in some embodiments to provide increased capacitive coupling.

Referring again to FIGS. 2 and 5-6, it can be seen that base station antenna 100 includes a plurality of the parasitic coupling units 500. The parasitic coupling units 500 may be arranged as a vertically-oriented linear array of parasitic coupling units 500 that extend down the center of the ground plane/reflector 214. A parasitic coupling unit 500 is provided between each pair of horizontally (transversely) aligned low-band radiating elements 300, and hence the number of parasitic coupling units 500 may be equal to the number of low-band radiating elements 300 in each of the low-band linear arrays 220 in some embodiments. Each parasitic coupling unit 500 may be horizontally aligned with a respective low-band radiating element 300 of each of the low-band linear arrays 220-1, 220-2. The positions of the parasitic coupling units 500 can be adjusted to tune the decoupling effects.

As shown in FIG. 6, each parasitic coupling unit 500 may extend forwardly from the ground plane/reflector 214 by a first distance H1. Likewise, each low-band radiating element 300 may extend forwardly from the ground plane/reflector 214 by a second distance H2. The amount that a parasitic coupling unit 500 or a radiating element 300, 400 extends forwardly from the ground plane/reflector 214 may also be referred to herein as the respective "heights" of the parasitic coupling units 500 and radiating elements 300, 400. As can be seen, in some embodiments H1 is less than H2. In some embodiments, H1 is less than half of H2. In some embodiments, H1 is less than one third of H2. In other words, in various embodiments, the height of each the parasitic coupling unit 500 may be less than, less than half, or less than one third, the height of each low-band radiating element 300. As will be discussed in more detail below, designing the parasitic coupling units 500 to have heights that are substantially less than the heights of the low-band radiating elements 300 may ensure that the parasitic coupling units 500 do not substantially block the radiation emitted by the high-band radiating elements 400 when they are transmitting RF signals.

When a signal is transmitted through the low-band radiating elements 300 of the first low-band linear array 220-1, each of the low-band radiating elements 300 will generate an electromagnetic field. In a conventional RRVV base station antenna, each of these electromagnetic fields may encompass one or more of the radiating elements 300 of the second low-band linear array 220-2, and will couple most strongly to the low-band radiating element 300 of the second low-band linear array 220-2 that is horizontally aligned with each respective transmitting low-band radiating element 300. These cross-couplings between the low-band radiating elements 300 of the two low-band linear arrays 220 typically degrades the radiation pattern of the transmitting low-band linear array 220-1, and may negatively impact the azimuth beamwidth, beam squint, cross-polarization isolation and the like. These negative effects result because a portion of the cross-coupled signals re-radiate from the low-band radiating elements 300 of the second low-band linear array 220-2. The RF energy radiated from the low-band radiating elements 300 of the second low-band linear array 220-2 typically is not in-phase with respect to the RF energy radiated from the low-band radiating elements 300 of the first low-band linear array 220-1. As a result, the radiation pattern of the first low-band linear array 220-1 may be distorted in undesirable ways, often including an increased azimuth beamwidth and lower gain values. The same effect occurs when the second low-band linear array 220-2 transmits RF signals.

The parasitic coupling units 500 may be positioned in the near field of respective low-band radiating elements 300 of the transmitting low-band linear array 220. In particular, a parasitic coupling unit 500 may be positioned between each pair of horizontally-aligned low-band radiating elements 300, where a first low-band radiating element 300 of the pair is part of the first low-band linear array 220-1 and the second low-band radiating element 300 of the pair is part of the second low-band linear array 220-2. When the first low-band radiating element 300 of a pair transmits an RF signal, the resulting electromagnetic field may extend onto the parasitic coupling unit 500. The slots 518 in the walls 514 may appear as magnetic dipoles which capture energy that would otherwise have impinged on the low-band radiating elements 300 of the non-active low-band linear array 220. The provision of the parasitic coupling unit 500 may significantly decrease the amount of RF energy that directly couples from the transmitting low-band radiating element 300 of the pair to the non-transmitting low-band radiating element 300 of the pair.

The electromagnetic field that is generated by the transmitting low-band radiating element 300 may generate surface currents on the forwardly-extending walls 514 of the parasitic coupling unit 500, and these surface currents may cause RF energy to be re-radiated from the parasitic coupling unit 500. The parasitic coupling unit 500 may be designed so that this re-radiated energy is largely in-phase with the RF signal energy that is radiated by the transmitting low-band radiating element 300. In particular, various aspects of the parasitic coupling unit 500 may be tuned so that the re-radiated energy is more in-phase including the length of the parasitic coupling unit 500 in the vertical direction, the height thereof (i.e., how far the wall 514 extends forwardly), the length of the slots 518 included in the sidewalls 514 in the vertical direction and the number of slots 518 provided. A portion of the energy that is re-radiated energy from the parasitic coupling unit 500 may still couple to the non-transmitting low-band radiating element 300 of the pair, but the parasitic coupling unit 500 may be tuned so that this re-radiated energy is also more in-phase with the RF energy that is radiated by the transmitting low-band radiating element 300. As a result, the radiation pattern of the transmitting low-band linear array 220 may be improved.

Moreover, since the cross-coupled RF energy that is re-radiated by the non-transmitting low-band radiating element 300 may be relatively in-phase with the RF energy transmitted by the transmitting low-band radiating elements 300, the re-radiated cross-coupled energy may appear to increase the aperture size of the first low-band linear array 220-1 in the azimuth plane, thereby narrowing the azimuth beamwidth of the low-band linear arrays 220. This may be advantageous in antenna designs where size constraints may otherwise make it difficult to provide a sufficiently narrow azimuth beamwidth, particularly for the low-band linear arrays 220. In some embodiments, the parasitic coupling units 500 may be designed to provide a net increase in the total coupling from a transmitting low-band radiating element 300 to the non-transmitting low-band radiating element 300 of each pair, since the cross-coupling, if properly controlled, can provide beneficial effects such as narrowing of the azimuth beamwidth.

As noted above, the parasitic coupling units 500 may be tuned by, for example, varying the number of slots 518 and/or the length of the slots 518. Simulation software such as CST Studio Suite and ANSYS HFSS may be used to select dimensions for the number of slots 518 and the length of the slots 518. The length and/or the height of the parasitic coupling unit 500 may also be varied to optimize performance of the antenna. Performance may then be further optimized by testing actual antennas with different parasitic coupling unit designs and measuring actual performance. The slots 518 may have a length between 0.4λ and 0.6λ in some embodiments, where λ is the wavelength corresponding to the center frequency of the low-band in some embodiments.

In the depicted embodiment, each parasitic coupling unit 500 includes two parasitic coupling structures 510, namely a first parasitic coupling structure 510-1 that is adjacent the first low-band linear array 220-1 and a second parasitic coupling structure 510-2 that is adjacent the second low-band linear array 220-2. With such a design, the parasitic coupling structure 510 that is closest to a transmitting low-band radiating element 300 tends to capture the majority of the RF energy and re-radiate the same. It will be appreciated, however, that in other embodiments a single parasitic coupling structure 510 may be used that, for example, is positioned midway between the two low-band linear arrays 220-1, 220-2. Such an embodiment is discussed below with reference to FIG. 8D. If only a single parasitic coupling structure 510 is used, it typically is necessary to re-tune the parasitic coupling structure 510 as the position thereof is typically changed and as it no longer interacts with another parasitic coupling structure 510 if the second parasitic coupling structure 510 is omitted.

It should be noted that while the parasitic coupling structures 510 in the embodiment depicted in FIG. 7 have an L-shaped cross-section along the length thereof, such a design is not necessary for proper operation of the parasitic coupling units 500. In particular, the primary functions of the base 512 may be (1) to provide a convenient surface for apertures 516 that are used to mount the parasitic coupling unit 500 to the ground plane/reflector 214 (or other surface) and (2) to provide capacitive coupling to the ground plane/reflector 214. Accordingly, it will be appreciated that the base 512 need not extend the full length of the parasitic coupling unit 500. In fact, the necessary capacitive connection may be achieved in a variety of ways, including decreasing the thickness of the dielectric spacer 530 and/or increasing the dielectric constant of the dielectric spacer 530 so that the surface area of the base 512 may be reduced considerably. It should be noted that the fasteners (not shown) used to attach the parasitic coupling unit 500 to the ground plane/reflector 214 may be plastic fasteners in order to avoid a direct galvanic connection between the parasitic coupling unit 500 and the ground plane/reflector 214.

Referring again to FIGS. 2-6, it can also be seen that the linear array of parasitic coupling units 500 extends between the two high-band linear arrays 230-1, 230-2. The height of each high-band radiating element 400 that is included in the high-band linear arrays 230 may be significantly less than the height of each low-band radiating element 300. In an RRVV antenna, the low-band radiating elements 300 may extend forwardly from the ground plane/reflector 214 two to three times as far as the high-band radiating elements 400. If the parasitic coupling units 500 have a height that is, for example, between one third and one half the height of a low-band radiating element 300, then the height of each parasitic coupling unit 500 may be about the same as, or a little less than, the height H3 of a high-band radiating elements 400. In some embodiments, the height H1 of each parasitic coupling unit 500 may be as follows:

$$0.5*H3<H1<H2$$

It will also be appreciated that the height H1 of the parasitic coupling units 500 may exceed the height H3 of the high-band radiating elements 400.

Designing the parasitic coupling units 500 to have heights H1 that are less than or equal to the heights H3 of the respective high-band radiating elements 400 may ensure that the parasitic coupling units 500 do not substantially block the radiation emitted by the high-band radiating elements 400 when they are transmitting RF signals. As the parasitic coupling units 500 may be located in very close proximity to the high-band radiating elements 400, it may be important in some antenna designs (and particularly designs with broad azimuth beamwidths) that the parasitic coupling units 500 extend forwardly from the ground plane/reflector 214 less than the high-band radiating elements 400. In other embodiments, the parasitic coupling units 500 may extend forwardly from the ground plane/reflector 214 a greater distance than the high-band radiating elements 400.

While the parasitic coupling units 500 may act as parasitic structures that capture and re-radiate low-band signal energy to improve the radiation patterns of the low-band linear arrays 220, they may serve a different function with respect to the high-band linear arrays 230. In particular, the parasitic coupling units 500 may act as RF radiation shields with respect to the high-band radiating elements 400. The one or more slots 518 included in the walls 514 may be designed to be relatively transparent at the high-band frequencies, and hence the walls 514 may appear as grounded metallic walls that are interposed between pairs of adjacent high-band radiating elements 400 of the two high-band linear arrays 230. Such (capacitively) grounded walls may act like RF radiation shields, thereby reducing cross-coupling between the transmitting high-band radiating elements 400 and the non-transmitting high-band radiating elements 400 of adjacent high-band linear arrays 230. Moreover, since the parasitic coupling units 500 may be nearly as tall as the high-band radiating elements 400, the parasitic coupling units 500 may be effective as an RF radiation shield in the high-band frequency range.

As is further shown in FIGS. 2-6, one or more arrays of parasitic strips 600 may also be included in the base station antenna 100. In particular, as shown best in FIGS. 5-6, a central array of parasitic strips 600 may extend along the centerline of the antenna 100. Each parasitic strip 600 may comprise a metal strip (which may be implemented, for example, using an elongated printed circuit board having a substantially continuous metal layer) that is mounted at approximately the same height above the ground plane as the radiators as the low-band radiating elements 300. Support structures 610 may be used to mount the parasitic strips 600 above the ground plane/reflector 214. The support structures 610 may be mounted within the internal cavities 520 of the parasitic coupling units 500, as is shown in FIGS. 5-6. In the depicted embodiment, the center of each parasitic strip 600 in the central array is vertically offset with respect to the low-band radiating elements 300. In other words, in some embodiments, a center of each parasitic strip 600 in the vertical direction falls in the middle of a square defined by four of the low-band radiating elements 300 when the antenna 100 is mounted for use. The positions of the center of each parasitic strip 600 may be varied to modify the radiation pattern.

In some embodiments, the antenna 100 may include additional arrays of parasitic strips 600 that extend along the outer edges of the antenna assembly 200. The outer arrays may be identical to the central array described above, except that the parasitic strips in the outer arrays may be vertically aligned with respect to the low-band radiating elements 300 (i.e., a center of each parasitic strip 600 in the outer arrays 270-2, 270-3 may be horizontally aligned with a center of a respective one of the low-band radiating elements 300 in the first low-band linear array 220-1 and with a center of a respective one of the low-band radiating elements 300 in the second low-band linear array 220-2).

As described above, the parasitic coupling units 500 according to embodiments of the present invention may capture RF energy transmitted from an adjacent transmitting low-band radiating element 300, at least some of which otherwise would have coupled to a non-transmitting low-band radiating element 300 of the other (non-transmitting) low-band linear array 220. The parasitic coupling units 500 may also be designed to re-radiate at least some of this RF energy. Some of the re-radiated RF energy may couple to a non-transmitting low-band radiating element 300 of the non-transmitting low-band linear array 220 and, in some cases, the parasitic coupling units 500 may increase the amount of RF energy that is coupled to a non-transmitting low-band radiating element 300. The parasitic coupling units 500 may be designed so that the re-radiated RF energy is closer to being in-phase with the RF energy transmitted by the transmitting low-band linear array 220. The parasitic coupling units 500 may narrow the azimuth beamwidth of the transmitting low-band linear array 220 as compared to the azimuth beamwidth that would be achievable if the parasitic coupling units 500 were not provided.

As noted above, the length, width and height of the parasitic coupling units 500 according to embodiments of the present invention may be varied to enhance the performance thereof. In some embodiments, the width of the parasitic coupling unit 500 may be between 0.05 and 0.154 of the wavelength corresponding to a center frequency of the combined operating frequency band of the low-band linear arrays 220. The height of the parasitic coupling unit 500 may be between 0.02 and 0.15 of the wavelength corresponding to the center frequency of the combined operating frequency band of the low-band linear arrays 220.

It will be appreciated that numerous variations may be made to the base station antennas and parasitic coupling units disclosed herein without departing from the scope of the present invention. For example, the number of linear arrays and/or radiating elements included in the base station antenna may be varied, as can the locations of the linear arrays. Likewise, parasitic coupling units may or may not be provided between each pair of radiating elements in different linear arrays. Additionally, the radiating elements in the different linear arrays need not be aligned with each other. It will also be appreciated that the parasitic coupling units could be made longer so that they can be interposed between multiple radiating elements in each of two side-by-side linear arrays, and multiple sets of slots 518 could be formed in these elongated parasitic coupling structures.

It will also be appreciated that, while the use of parasitic coupling units has primarily been described above with reference to low-band linear arrays that operate in some or all of the 694-960 MHz frequency band, embodiments of the present invention are not limited thereto. Instead, the parasitic coupling units described herein may be designed to perform the same parasitic coupling function with respect to other frequency bands. It will also be appreciated that the parasitic coupling units will not always be designed to act as an RF radiation shield with respect to linear arrays in other frequency bands.

FIGS. 8A-8D are schematic perspective views of example alternative embodiments of the parasitic coupling unit 500.

Figure 8A:
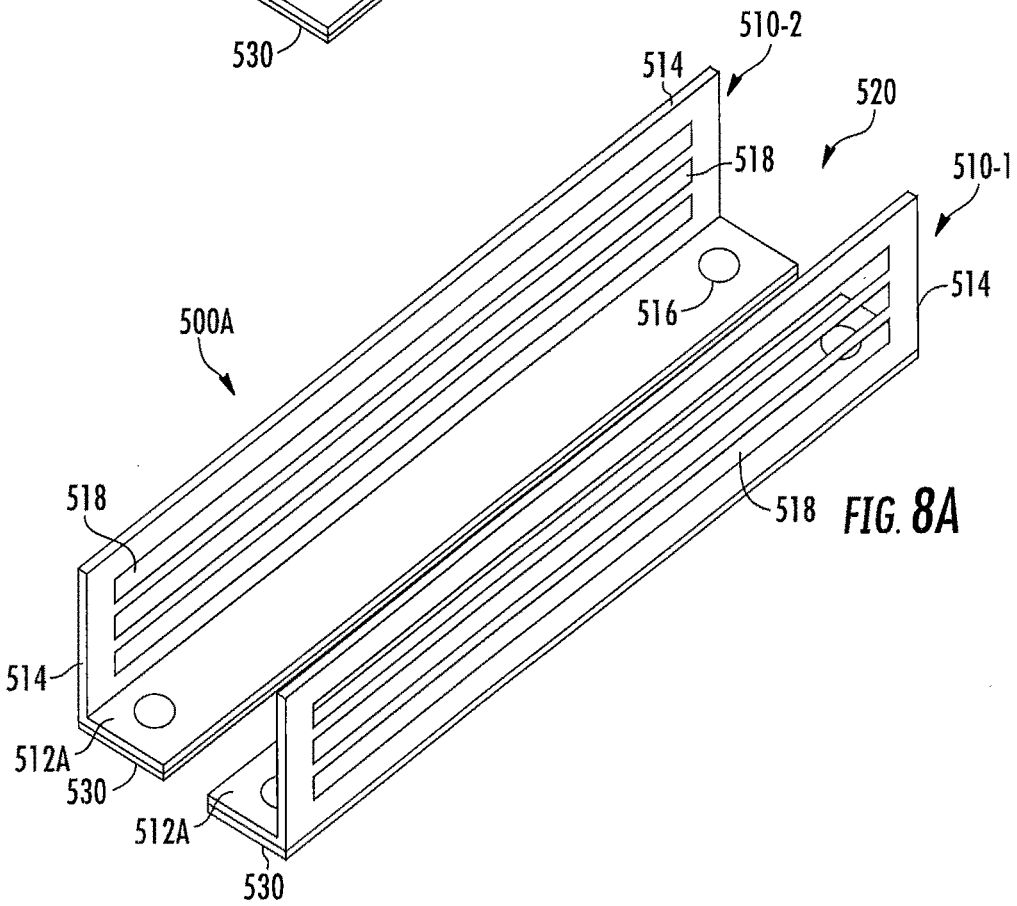
FIGS. 8A-8D are perspective views of a parasitic coupling units according to further embodiments of the present invention.

For example, the base 512 of the parasitic coupling unit 500 may be modified in various ways. Referring first to FIG. 8A, a parasitic coupling unit 500A is illustrated that is similar to the parasitic coupling unit 500, except that the base 512A on each parasitic coupling structure 510 of parasitic coupling unit 500A extends inwardly (i.e., toward the other parasitic coupling structure 510) instead of outwardly as in the case of parasitic coupling unit 500.

Figure 8B:
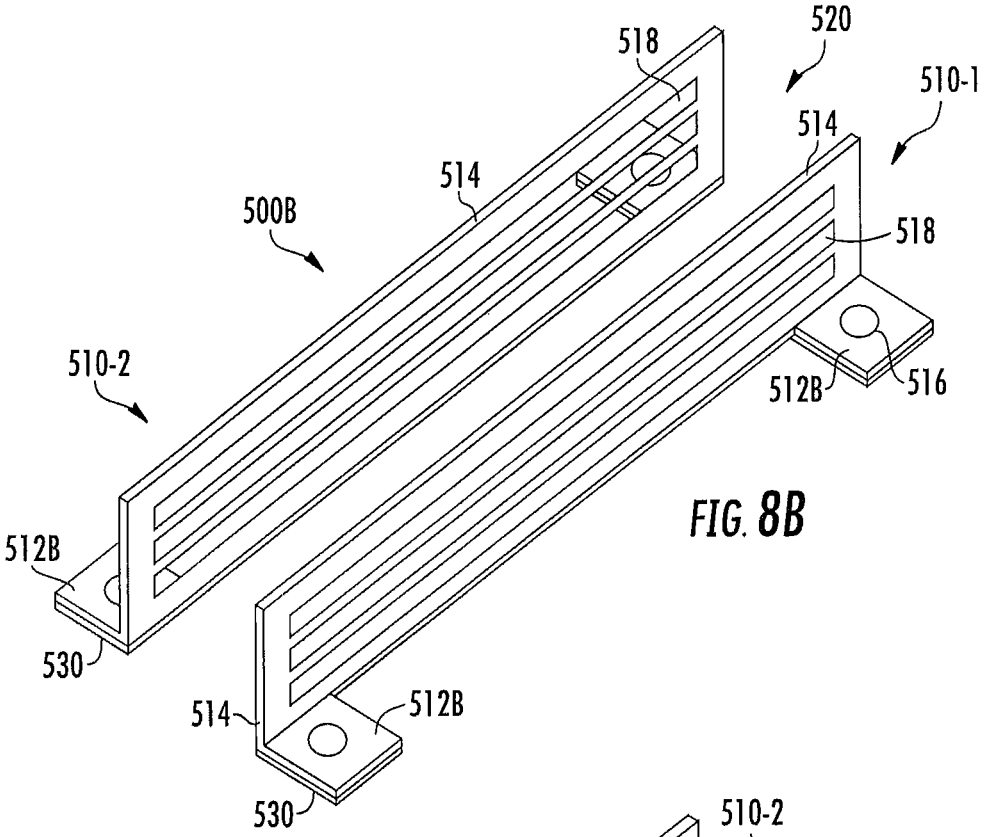

As another example, FIG. 8B illustrates a parasitic coupling unit 500B that again is similar to the parasitic coupling unit 500 of FIG. 7, except that the base on each parasitic coupling structure 510 of parasitic coupling unit 500B comprises a pair of tabs 512B as opposed to a strip that extends the full length of the wall 514. In other embodiments, one or more of the tabs 512B may extend inwardly instead of outwardly.

Figure 8C:
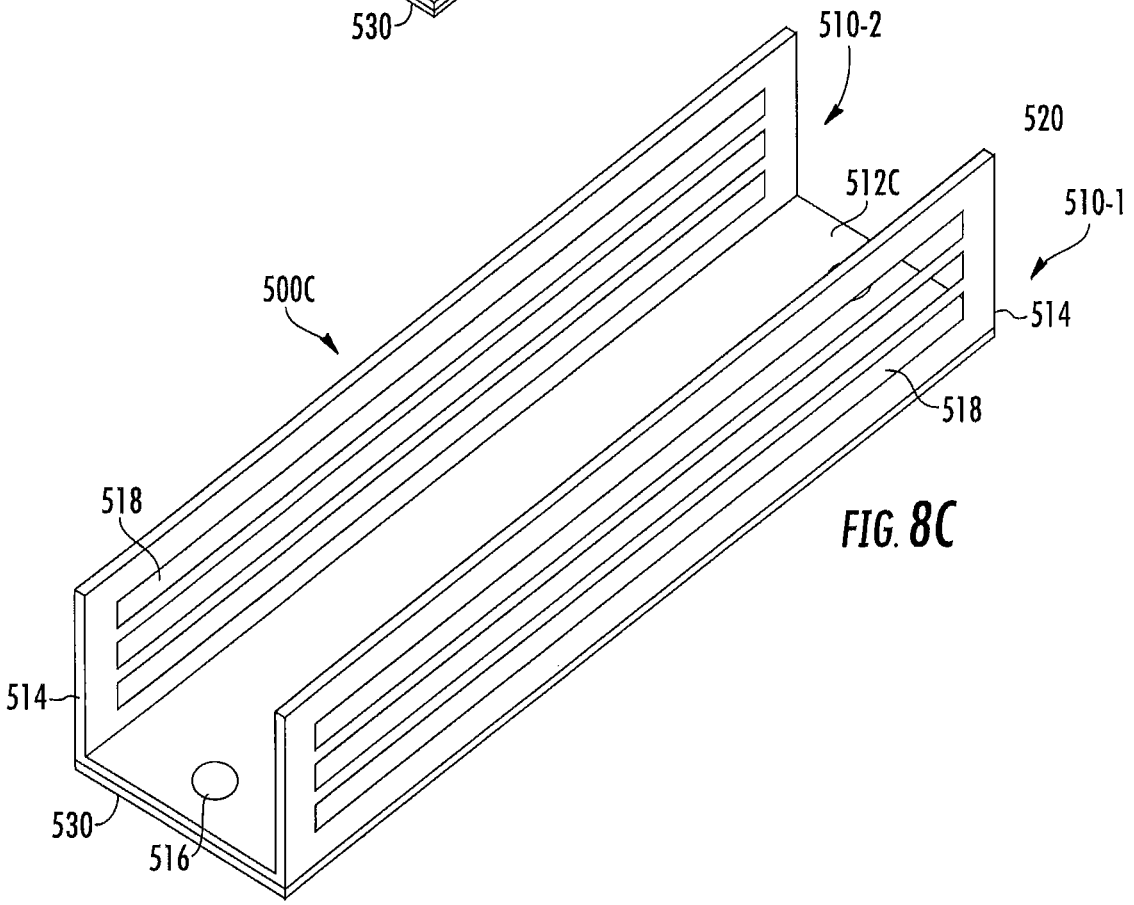

As yet another example, FIG. 8C illustrates a parasitic coupling unit 500C that is similar to the parasitic coupling unit 500A of FIG. 8A, except that the parasitic coupling unit 500C comprises a unitary base 512C.

Figure 8D:
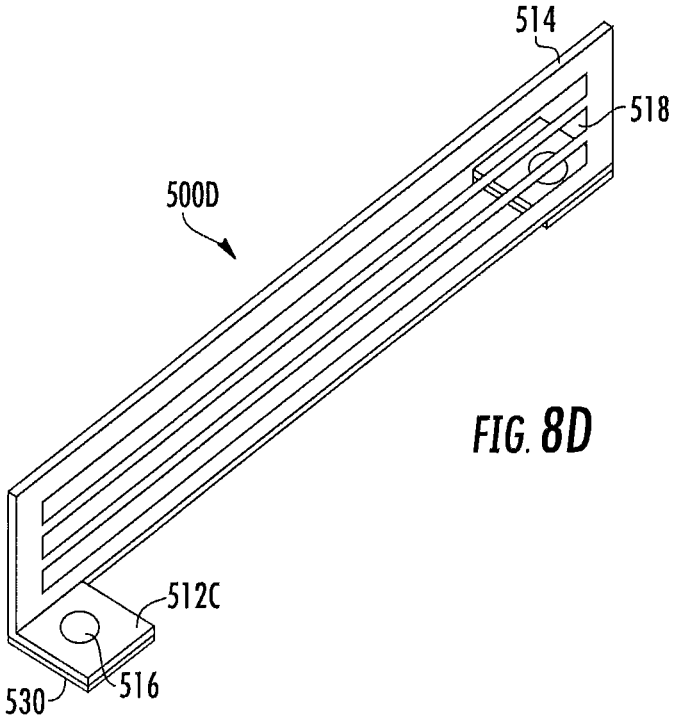

As mentioned above, in still other embodiments, parasitic coupling units may be provided that include a single parasitic coupling structure 510 as opposed to a pair of parasitic coupling structures 510. FIG. 8D depicts one such parasitic coupling structure 500D. While the parasitic coupling structure 500D uses tabs 512C to implement the base, it will be appreciated that any of the above-described designs for the base could be used, as well as any other base design that performs one or both of the above-described functions of the base.

The parasitic coupling units according to embodiments of the present invention may work by diverting a portion of the electromagnetic field generated by a radiating element toward the parasitic coupling unit as opposed to toward a radiating element of another linear array. The parasitic coupling unit may then re-radiate RF energy, including RF energy onto one or more of the radiating element of a nearby, non-transmitting linear array. The parasitic coupling unit may be designed so that the re-radiated RF energy is more in-phase with the RF energy emitted by the transmitting radiating elements, and hence may reduce the impact that the radiating elements of the nearby linear array have on the radiation pattern of the transmitting linear array.

The present invention has been described above with reference to the accompanying drawings, in which certain embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A base station antenna, comprising:

a panel that includes a ground plane;

a first linear array that includes a first plurality of radiating elements that extend forwardly from the panel, the first linear array extending along a first axis;

a second linear array that includes a second plurality of radiating elements that extend forwardly from the panel, the second linear array extending along a second axis that is generally parallel to the first axis; and a parasitic coupling unit between a first radiating element of the first linear array and a first radiating element of the second linear array and between the first axis and the second axis, wherein the parasitic coupling unit includes a first parasitic coupling structure, the first parasitic coupling structure including a first base that is capacitively coupled to the ground plane and a first wall that extends forwardly from the first base, the first wall including at least one slot, wherein the ground plane includes a planar portion, the radiating elements extend forwardly from the planar portion of the ground plane, and the first base extends in parallel to the planar portion of the ground plane, and wherein the first base, the first radiating element of the first linear array and the first radiating element of the second linear array are all on a same side of the ground plane.

2. The base station antenna of claim 1, wherein the parasitic coupling unit and the first and second linear arrays are on a same side of the panel.

3. The base station antenna of claim 2, wherein the parasitic coupling unit further includes a second parasitic coupling structure, the second parasitic coupling structure including a second base that is capacitively coupled to the ground plane and a second wall that extends upwardly from the second base and extends parallel to the first wall, the second wall including at least one slot.

4. The base station antenna of claim 3, wherein each of the first and second walls includes at least two slots that extend in parallel to each other.

5. The base station antenna of claim 4, wherein the first parasitic coupling structure is spaced apart from the second parasitic coupling structure and does not directly contact the second parasitic coupling structure.

6. The base station antenna of claim 5, wherein the first and second parasitic coupling structures define an internal cavity therebetween, and wherein a mounting structure for a parasitic strip extends upwardly from the ground plane through the internal cavity.

7. The base station antenna of claim 2, wherein the parasitic coupling unit further includes a dielectric spacer that separates the parasitic coupling unit from the ground plane.

8. The base station antenna of claim 2, further comprising:

a third plurality of radiating elements that are part of a third linear array; and a fourth plurality of radiating elements that are part of a fourth linear array, wherein the first parasitic coupling structure is between a first of the first plurality of radiating elements and a first of the second plurality of radiating elements, and is further between a first of the third plurality of radiating elements and a first of the fourth plurality of radiating elements, and wherein each radiating element in the first plurality of radiating elements is configured to transmit and receive radio frequency signals in at least a first portion of a first frequency band, each radiating element in the second plurality of radiating elements is configured to transmit and receive radio frequency signals in at least a second portion of the first frequency band, each radiating element in the third plurality of radiating elements is configured to transmit and receive radio frequency signals in at least a first portion of a second frequency band that is higher than the first frequency band, and each radiating element in the fourth plurality of radiating elements is configured to transmit and receive radio frequency signals in at least a second portion of the second frequency band.

9. The base station antenna of claim 1, wherein the first base extends in a first plane and dipole radiators of the first radiating element of the first linear array extend in a second plane that is parallel to the first plane.

10. The base station antenna of claim 9, wherein a height of the first wall above the ground plane is less than a height of at least one of the first plurality of radiating elements above the ground plane.

11. The base station antenna of claim 1, wherein dimensions of the at least one slot are configured so that surface currents generated on the parasitic coupling unit by first radio frequency energy transmitted by the first plurality of radiating elements will re-radiate second radio frequency energy that is more in-phase with the first radio frequency energy transmitted by the first plurality of radiating elements.

12. A base station antenna, comprising:

a panel that includes a ground plane;

a first linear array that includes a first plurality radiating elements that extend forwardly from the panel, the first linear array extending along a first axis;

a second linear array that includes a second plurality of radiating elements that extend forwardly from the panel, the second linear array extending along a second axis that is generally parallel to the first axis; and a plurality of parasitic coupling units extending along a third axis between the first linear array and the second linear array, wherein each parasitic coupling unit comprises spaced-apart first and second metal parasitic coupling structures that face each other to define an internal cavity therebetween, each parasitic coupling structure including a base and a wall that extends forwardly from the base, wherein at least some of the parasitic coupling units are tuned to increase the phase alignment between RF energy radiated by the first linear array that is not absorbed by elements of the base station antenna and RF energy radiated by the first linear array that is absorbed by ones of the second plurality of radiating elements and re-radiated therefrom.

13. The base station antenna of claim 12, wherein each wall includes at least one slot that extends generally parallel to the second axis.

14. The base station antenna of claim 12, wherein each of the first and second metal parasitic coupling structures is mounted on a respective dielectric spacer and is capacitively coupled to the ground plane.

15. The base station antenna of claim 12, wherein a height of each wall above the ground plane is less than one half a height of at least one of the first plurality of radiating elements above the ground plane.

16. A base station antenna, comprising:

a panel that includes a ground plane;

a first low-band linear array that includes a first plurality of low-band radiating elements that are mounted to extend forwardly from the panel;

a second low-band linear array that includes a second plurality of low-band radiating elements that are mounted to extend forwardly from the panel;

a first high-band linear array that includes a first plurality of high-band radiating elements that are mounted to extend forwardly from the panel;

a second high-band linear array that includes a second plurality of high-band radiating elements that are mounted to extend forwardly from the panel;

a plurality of parasitic coupling units extending along an axis between the first low-band linear array and the second low-band linear array, wherein each low-band radiating element is configured to transmit and receive radio frequency signals in at least a portion of a first frequency band and each high-band radiating element is configured to transmit and receive radio frequency signals in at least a portion of a second frequency band that has a lowest frequency that is higher in frequency than the highest frequency in the first frequency band, and wherein each parasitic coupling unit comprises a base and a wall that extends forwardly from the base and is configured to collect and re-radiate RF energy in the first frequency band.

17. The base station antenna of claim 16, wherein the plurality of parasitic coupling units also extend between the first high-band linear array and the second high-band linear array.

18. The base station antenna of claim 17, wherein the parasitic coupling units are configured to act as RF shields that isolate the first high-band linear array from the second high-band linear array.

19. The base station antenna of claim 16, wherein the walls of at least some of the parasitic coupling units include at least one slot.

20. The base station antenna of claim 16, wherein each of the parasitic coupling units is capacitively coupled to the ground plane.

21. The base station antenna of claim 16, wherein a height of each wall above the ground plane is less than one half a height of at least one of the first plurality of radiating elements above the ground plane and is at least two thirds a height of at least one of the third plurality of radiating elements above the ground plane.

22. The base station antenna of claim 16, wherein the parasitic coupling units are on a same side of the panel as the first and second low-band linear arrays.

* * * * *